United States Patent [19]

Cobb

[11] Patent Number: 4,687,947

[45] Date of Patent: Aug. 18, 1987

[54] ELECTRICAL POWER CONSERVATION CIRCUIT

[76] Inventor: Melvin Cobb, 239 E. 69th Way, North Long Beach, Calif. 90805

[21] Appl. No.: 699,807

[22] Filed: Feb. 8, 1985

[51] Int. Cl.[4] ..... H01F 33/00

[52] U.S. Cl. ..... 307/17; 307/32; 336/180; 336/182; 336/184

[58] Field of Search ..... 307/7, 15, 17, 32, 36, 307/401–423; 336/148, 180, 182, 184; 323/355, 308, 309

[56] References Cited

U.S. PATENT DOCUMENTS

| | | | |
|---|---|---|---|
| 1,351,033 | 8/1920 | Fortescue | 307/32 X |
| 1,485,727 | 3/1924 | Sindeband | 307/7 X |
| 1,659,469 | 2/1928 | Owen | 336/184 X |
| 1,848,936 | 3/1932 | Cole | 307/17 X |
| 2,307,217 | 1/1943 | Hansell | 307/32 |
| 2,665,406 | 1/1954 | Carmichael | 307/17 X |
| 2,686,291 | 8/1954 | Macklem | 307/32 X |
| 2,997,599 | 8/1961 | Bonn et al. | 307/416 |
| 3,140,401 | 7/1964 | Feissel | 307/407 X |
| 3,237,090 | 2/1966 | Royer et al. | 307/17 X |
| 3,398,292 | 8/1968 | Kuba | 307/51 |
| 3,447,068 | 5/1969 | Hart | 323/308 |
| 3,631,333 | 12/1971 | Pichal | 323/355 |
| 3,675,119 | 7/1972 | Libkind et al. | 307/17 X |
| 3,716,719 | 2/1973 | Angelery et al. | 336/184 X |
| 3,753,189 | 8/1973 | Allen | 336/182 X |
| 4,020,438 | 4/1977 | Manimalethu | 336/180 X |
| 4,156,222 | 5/1979 | Rossman et al. | 336/184 X |
| 4,300,112 | 11/1981 | Leibinger | 336/180 |
| 4,367,025 | 1/1983 | Metzger | 307/17 X |
| 4,403,205 | 9/1983 | Leibinger et al. | 336/180 |

FOREIGN PATENT DOCUMENTS

| | | | |
|---|---|---|---|
| 0642307 | 7/1962 | Italy | 336/184 |
| 16966 | 9/1963 | Japan | 336/180 |

*Primary Examiner*—William M. Shoop, Jr.
*Assistant Examiner*—Shik Luen Paul Ip
*Attorney, Agent, or Firm*—Charles H. Thomas

[57] ABSTRACT

An alternating power supply system is provided with a circuit which employs a transformer having three windings. The primary and secondary windings are wound in the direction upon a magnetically permeable core. A third winding is connected to a load and produces flux in the core in the opposite direction. The magnetic field produced by the third winding proportionally decreases the power input of the primary winding while maintaining the power output of the secondary winding. The circuit thereby reduces the power drain necessary to operate a given load.

6 Claims, 4 Drawing Figures

FIG 1
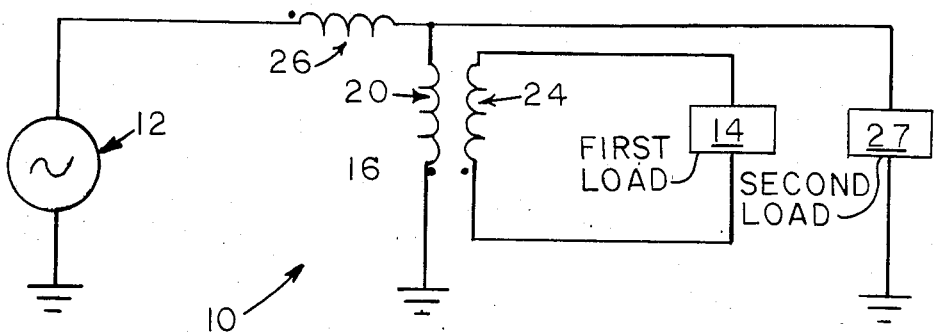
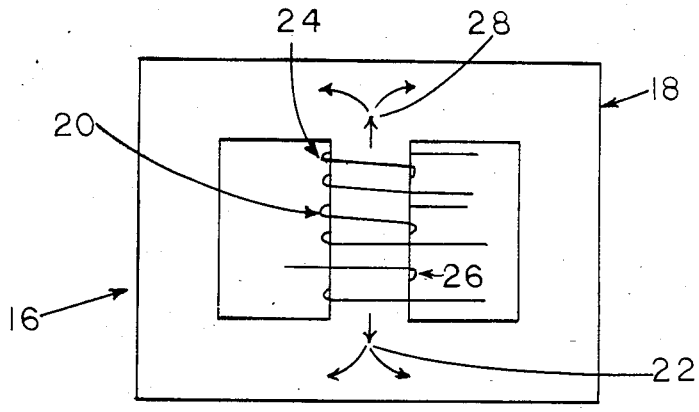
FIG. 3
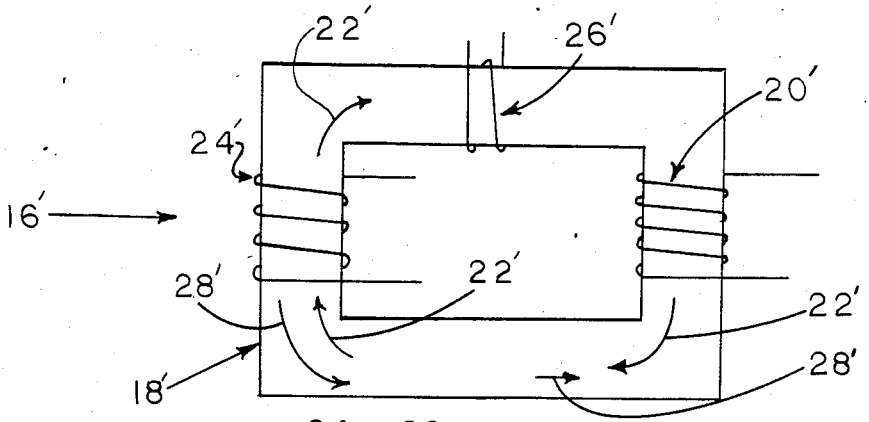
FIG. 4
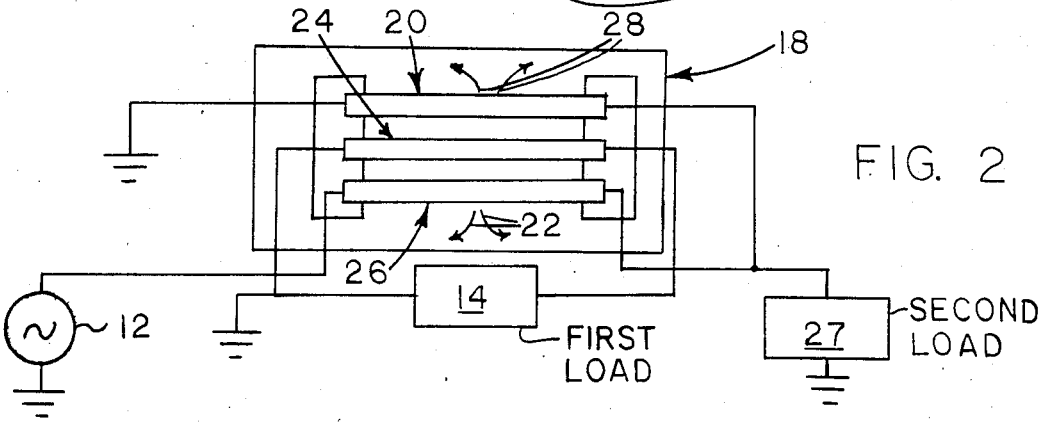
FIG. 2

ELECTRICAL POWER CONSERVATION CIRCUIT

BACKGROUND OF THE INVENTION

1. Field of the Invention

The present invention relates to an electrical power conversion circuit designed for use with an alternating current power supply connected to a load.

2. Description of the Prior Art

Conventional commercial public utility power is provided in this country as 60 hertz alternating current power from 110 to 120 volts. Commercial public utility power lines are stepped down from a higher voltage by means of transformers located on public utility power poles and in subterranean vaults. The alternating current power supply lines are wired into separate power distribution panels in each building. Each power distribution panel normally includes at least one main circuit breaker or fuse, and a series of secondary circuit breakers or fuses which are coupled in circuit to loads within the building.

SUMMARY OF THE INVENTION

The present invention involves a means for reducing the power drain from commercial public utility power supply lines while maintaining a power output to operate the conventional loads in businesses and residences which are driven by commercial, electrical alternating current power. According to the invention a load isolating electrical transformer is connected to the incoming public utility power supply lines. The transformer includes primary and secondary windings wound on a magnetically permeable core in such a fashion that the magnetic flux produced by current flowing through the primary and secondary windings is in the same direction in the core. A third, or return winding is also wound on the same magnetically permeable core, but in the opposite direction. That is, magnetic flux in the core produced by electrical current flowing through the third winding is in the opposite direction to the magentic flux produced by electrical currents in the primary and secondary windings. This condition also happens when all three windings are in the same direction but current flow through the third coil is opposite to that in the primary.

The public utility power lines are connected to the primary winding of the transformer. The supply of alternating electrical current to the primary winding induces a flow of electrical current in the secondary winding and in the third or return winding. The transformer is preferably located between the main circuit breaker and the power distribution panel of a building. The secondary winding is connected to most of the secondary circuits terminating in the power distribution panel, but the third or return winding is connected to at least one of the secondary circuits. Preferably, the third winding is connected in line with the main power feed to all circuits.

The flow of the alternating electrical current in the primary winding induces electrical current flow in both the secondary and third windings of the transformer. The induced electrical current in each of these windings powers the loads which are respectively coupled to each of these windings.

Since the third winding produces magnetic flux in a direction opposing the magnetic flux of the primary winding, the presence of the third winding increases the impendance in the primary winding. This increased impedance results in a reduced current flow in the primary winding, thereby reducing the current drain from the public utility power supply lines. Since the current flow in the secondary winding is induced by the current flow in the primary winding, the secondary winding acts as a load with respect to the primary winding. The electrical current flow in the primary winding produces a magnetic flux in the core which causes a flow of electrical current in the secondary winding. Since the third winding also acts as a load with respect to the power coming in, the flux induced in the core by the flow of current through the third winding is in a direction opposite to that of the secondary winding. This flux produced by the third winding reduces the impedance in the secondary winding so that the electrical current in the secondary winding is not reduced by the reduction of current in the primary winding that results from the presence of the third winding.

The presence of the third winding on the load isolation transformer produces a magnetic field which decreases the energy input from the primary winding, but keeps the energy output in the secondary winding the same. Depending upon the number of turns and the load magnitudes the transformer of the invention reduces electrical energy consumption from between about 15 to 30% as compared with conventional public utility power supply systems.

The ideal condition for maximum efficiency and maximum energy consumption reduction is for: (1) the magnetic fields of all three of the windings to be equal in absolute magnitude; (2) for the product of current times the number of turns in each winding to be equal in absolute magnitude; and (3) for the sum of the magnetic fields of the primary and the return windings to be equal to the total magnetic field.

The ideal conditions may be stated in algebraic terms in the following manner:

$$M_P + (-M_S) = 0 \; M_P = M_S; \; A_P T_P = A_S T_S; \; \frac{A_P}{T_S} = \frac{A_S}{T_P} -$$

$$M_S + M_{RC} = 0; \; M_{RC} = M_S; \; A_{RC} T_{RC} = A_S T_S; \; \frac{A_{RC}}{A_S} = \frac{T_S}{T_{RC}}$$

$$M_P + M_{RC} = M_T$$

The parameters employed in the foregoing algebraic equations is as follows:

$A_S$=amps in secondary coil
$T_s$=turns of secondary coil
$A_P$=amps in primary coil
$A_S$=amps in primary coil
$M_S$=magnetic field of secondary
$M_P$=magnetic field of primary
$M_{RC}$=magnetic field of return coil or third coil
$M_T$=total magnetic field
$-M_S$(the field resulting from the load on the primary winding imposed by the secondary winding which is opposite relative to the field of the primary winding that created it).

The invention may be described with greater clarity and particularity by reference to the accompanying drawings.

DESCRIPTION OF THE DRAWINGS

FIG. 1 is a schematic diagram of an alternating current circuit including the power conservation transformer of the invention.

FIG. 2 is a block diagram illustrating a typical embodiment of the circuit of the invention.

FIG. 3 is a diagram of the transformer of the invention illustrating the direction in which the windings are disposed on the transformer core.

FIG. 4 illustrates the direction of transformer winding disposition on a core in one alternative embodiment of the transformer of the invention.

DESCRIPTION OF THE EMBODIMENTS

FIG. 1 illustrates an alternating current circuit 10 which includes a typical commercial public utility alternating current power supply 12 and a first load 14 coupled thereto. According to the invention a transformer 16 is interposed between the alternating current power supply 12 and the load 14. The transformer 16 has a magnetically permeable soft iron core 18, illustrated in FIGS. 2 and 3. A primary winding 20 is connected to the power supply 12 and is wound on the core 18 to produce a magnetic flux therein a first direction indicated by the directional arrows 22 for a particular moment in time. A secondary winding 24 is connected to the first load 14 and is wound on the core in the same direction as the primary winding 20, as depicted in FIG. 3. The secondary winding 24 produces magnetic flux in the core 18 in the same first direction at the same moment in time indicated by the directional arrows 22.

A third or return winding 26 is wound on the core 18 in the opposite direction from the primary and secondary windings, as illustrated in FIG. 3, and is connected to a second load 27. The third winding 26 is wound on the core 18 to produce magnetic flux therein in a direction opposite to the direction of the directional arrows 22 at the same particular moment in time. The direction of magnetic flux produced by the third winding 26 is indicated by the directional arrows 28.

The windings on the transformer 16 have been simplified for ease of illustration in FIG. 3. To produce an energy conservation circuit of high efficiency, the primary and secondary windings may both consist of 120 turns of wire, while the third winding may have 50 turns of wire when the transformer 16 is used with a conventional public utility 60 hertz, 120 volt alternating current power supply.

An alternate embodiment of the transformer of the invention is depicted in FIG. 4. The transformer 16' employs a soft iron core shaped in the form of a closed rectangle or ring 18'. The primary winding 20' is disposed on one arm of the core 18' to produce magnetic flux in clockwise direction as indicated by the directional arrows 22'. The secondary coil 24' is wound on another leg of the core 18' so as to produce magnetic flux in the same direction also as indicated by the directional arrows 22'. The third or return winding 26' is wound in the opposite direction on a third leg of the core 18' to produce magnetic flux in the opposite, counterclockwise direction indicated by the directional arrows 28'.

Preferably, the primary winding 20' may consist of 120 turns, while the secondary winding 24' may also consist of 120 turns. When used in a conventional 60 hertz, 120 volt alternating current system, the third winding 26' preferably is formed of 5 turns on the transformer core 18'.

Undoubtedly, numerous other variations and modifications of the invention will become readily apparent to those familiar with the provision of commercial, alternating current power. For example, while a simplified embodiment of the invention has been illustrated for use with a single phase power supply, the invention is readily adaptable for use with multi-phase power. Accordingly, the scope of the invention should not be construed as limited to the specific embodiments depicted and described, but rather as defined in the claims appended hereto.

I claim:

1. An electrical power conservation circuit for use with an alternating current power supply and first and second loads comprising a load isolating transformer having a magnetically permeable core, a separate primary winding connected to said power supply and wound on said core to produce magnetic flux in a first direction in said core, a secondary winding separate and isolated from said primary winding connected to said first load and wound on said core to produce magnetic flux in said same first direction in said core, and a return winding connected to said second load and wound on said core to produce magnetic flux in a direction opposite to said first direction.

2. A power conservation circuit according to claim 1 in which the magnetic fields of said windings are equal in absolute magnitude and the product of current times number of turns in each winding is equal in absolute magnitude, and the sum of the magnetic fields of said primary and return windings is equal to the total magnetic field of said transformer.

3. An electrical power conservation circuit for an alternating current power source for use with first and second loads comprising a load isolating transformer having a magnetically permeable core, a separate primary winding wound on said core and connected to said alternating current power source, a secondary winding separate and isolated from said primary winding and wound on said core in the same direction as said primary winding and connected to said first load, and a third winding on said core wound in the opposite direction from said primary and secondary windings and coupled to a second load.

4. An electrical power conservation circuit according to claim 3 in which the magnetic fields of said windings are equal in absolute magnitude and the product of current times number of turns in each winding is equal in absolute magnitude, and the sum of the magnetic fields of said primary and third windings is equal to the total magnetic field of said transformer.

5. In an alternating current circuit including an alternating current power supply and a first load connected thereto the improvement comprising a load isolating transformer having a magnetically permeable core, a separate primary winding connected to said power supply and wound on said core to produce magnetic flux therein in a first direction, a secondary winding separate and isolated from said primary winding and connected to said first load and wound on said core to produce magnetic flux therein in said same first direction, and a third winding connected to a second load and wound on said core to produce magnetic flux therein in a direction opposite to said first direction.

6. An alternating current circuit according to claim 5 in which the magnetic fields of said windings are equal in absolute magnitude and the product of current times number of turns in each winding is equal in absolute magnitude, and the sum of the magnetic fields of said primary and third windings is equal to the total magnetic field of said transformer.

* * * * *